United States Patent [19]

Kamp

[11] Patent Number: 4,767,220

[45] Date of Patent: Aug. 30, 1988

[54] INTERLOCKING CLOSURE BAR FOR USE IN HIGH TEMPERATURE ENVIRONMENT

[75] Inventor: Ewald A. Kamp, Chicago, Ill.

[73] Assignee: First Brands Corporation, Danbury, Conn.

[21] Appl. No.: 85,319

[22] Filed: Aug. 10, 1987

Related U.S. Application Data

[60] Continuation of Ser. No. 783,117, Oct. 2, 1985, abandoned, which is a division of Ser. No. 567,242, Dec. 30, 1983, Pat. No. 4,561,108.

[51] Int. Cl.[4] ..... B65D 33/24

[52] U.S. Cl. ..... 383/63; 383/65

[58] Field of Search ..... 383/63, 64, 65, 109, 383/112, 118, 119; 24/201, 339, 389, 400, 586, 587; 156/66, 465; 264/117 R; 206/484

[56] References Cited

U.S. PATENT DOCUMENTS

| | | | |
|---|---|---|---|
| 2,869,207 | 1/1959 | Bernstein | 24/201 |
| 3,153,269 | 10/1964 | Berry | 24/400 |
| 3,338,285 | 8/1967 | Jaster | 24/587 |
| 3,354,473 | 11/1967 | Schwarz et al. | 4/172 |
| 3,389,733 | 6/1968 | Siegel | 150/3 |
| 3,403,429 | 10/1968 | Smith | 24/204 |
| 3,416,585 | 12/1968 | Steller | 150/3 |
| 3,428,742 | 2/1969 | Smith | 174/136 |
| 3,535,746 | 10/1970 | Thomas | 24/30.5 |
| 3,633,642 | 1/1972 | Siegel | 150/3 |
| 3,827,472 | 8/1974 | Uramoto | 383/119 |
| 3,846,575 | 11/1974 | Troy | 174/41 |
| 3,987,835 | 10/1976 | Bloomfield | 160/392 |
| 4,285,105 | 8/1981 | Kirkpatrick | 383/63 |
| 4,323,586 | 4/1982 | Long | 383/109 |
| 4,341,825 | 7/1982 | Kemski | 206/484 |
| 4,358,466 | 11/1982 | Stevenson | 426/106 |
| 4,401,256 | 8/1983 | Krieg | 229/53 |
| 4,471,872 | 9/1984 | Dedow | 383/109 |
| 4,516,268 | 5/1985 | Kamp | 383/63 |
| 4,528,224 | 7/1985 | Ausnit | 156/66 |
| 4,561,108 | 12/1985 | Kamp | 383/63 |
| 4,561,109 | 12/1985 | Herrington | 383/63 |

FOREIGN PATENT DOCUMENTS

| | | | |
|---|---|---|---|
| 2,701,590 | 7/1978 | Fed. Rep. of Germany | 24/400 |
| 1084488 | 1/1955 | France | 16/1 |
| 1,483,652 | 6/1967 | France | 383/63 |
| 1187640 | 4/1970 | United Kingdom | 24/400 |
| 2037704 | 7/1980 | United Kingdom . | |

*Primary Examiner*—David T. Fidei

*Attorney, Agent, or Firm*—Gary L. Wamer

[57] ABSTRACT

A flexible container for storing foods in a freezer and cooking foods therein. The container includes an interlocking closure fastening device comprising an omega-shaped closure element and a co-acting clamping closure element. The co-acting clamping closure element may have a profile portion comprising two generally parallel arm portions wherein one of the arm portions terminates in an inwardly curved hook portion, and the other arm portion curves slightly inward prior to terminating in an outwardly extending clamp portion; or the profile portion may comprise two outwardly curved arm portions wherein one of the arm portions terminates in an inwardly curved hook portion, and the other arm portion curves inwardly prior to terminating in a slightly outwardly curved hook portion; or the profile portion may comprise one inwardly curved arm portion terminating in an inwardly curved hook portion, and one generally straight arm portion.

75 Claims, 8 Drawing Sheets

INTERLOCKING CLOSURE BAR FOR USE IN HIGH TEMPERATURE ENVIRONMENT

CROSS REFERENCE TO RELATED APPLICATION

This application is a continuation of prior U.S. application Ser. No. 783,117, filing date Oct. 2, 1985, now abandoned, which is a divisional of application Ser. No. 567,242, filing date Dec. 30, 1983, now U.S. Pat. No. 4,561,108.

This application is related to copending application Ser. No. 567,350 filed Dec. 30, 1983 for Single Hinge Interlocking Closure Profile Configuration.

FIELD OF THE INVENTION

This invention relates to a container having high resistance to heat, making it suitable for use in direct food contact cooking, and more particularly, to a food container including an interlocking closure fastening device comprising an omega-shaped closure element and a co-acting clamping closure element.

BACKGROUND OF THE INVENTION

In general, closure fastening devices for use in connection with plastic bags and the like are known. Furthermore, manufacturing methods for closure fastening devices made of plastic material are generally well-known.

In operation, a closure fastening device for use in connection with a flexible container should be relatively easy to open from the outside, but relatively difficult to open from the inside. Generally, such a container can be used with its interior either under relatively high pressure or under relatively low pressure with respect to ambient conditions. The closure fastening device should provide a satisfactory seal for either condition.

Preferably, the closure fastening device should be suitable for economical manufacturing and should be relatively simple in design. In addition, the design should provide for variations in order to meet different needs. For example, it may be desirable to have a closure fastening device which is relatively difficult to open both from the inside and the outside. In general, the closure fastening device, however, should always be relatively easy to close.

In addition, when the closure fastening device is employed with a container, the container may be made from a thermoplastic material, and the closure device and sidewalls of the container can be made integrally by extrusion as a unitary piece, or can be made as separate components which are subsequently permanently connected together.

However, the thermoplastic resin materials heretofore found practical for the extrusion of interlocking closure devices, and their attachment to films, such as in making containers, have resulted in shrinkage and distortion problems during their use at elevated temperatures. Typical resin materials employed for interlocking closure devices and container films have included polyethylenes, polyvinyl chloride copolymers, and synthetic rubbers. However, none of these construction materials have sufficient thermal tolerance for many commercial uses. Further, both occlusion and deocclusion of the prior art interlocking closure devices are generally difficult to accomplish by the user when the device is made from resin materials having high temperature tolerances due to the higher flexural moduli usually associated with resins having higher temperature softening points.

The rapid advent of the working housewife, currently comprising about fifty percent of all households, has brought with it the need for time-saving and labor-saving devices. More then ever, householders perpare meals in advance and freeze them, as well as cook larger portions than required for a single meal. Quick cooking appliances like microwave ovens are rapidly increasing their market share and, not surprisingly, labor saving devices, even disposable devices, are finging increasing use.

Containers of the type considered herein have wide consumer use and usually feature two flexible side walls and a closure fastening device which can generally withstand moderate forces which would tend to open the container unexpectedly due to internal pressure. One more recent use of such containers is in microwave cooking of foods packaged therein. Thus, foods packaged in such containers may be stored in a freezer, removed therefrom, and placed in a microwave oven, where the foods are cooked directly in the containers. Likewise, foods packaged in such containers may be taken from a freezer and placed in boiling water to cook the foods.

However, such food storage bags and cooling containers, when made from thermoplastic resin materials, must meet stringent requirements. For example, when the food container is placed in boiling water, temperatures of up to about 215° F. may be reached, and on a gas range or electric stove, temperatures may reach up to about 320° F. above the water level on the wall of a skillet. Likewise, the fat content of meats may easily reach temperatures of about 300° F. in a microwave oven.

Unfortunately, it has been found that conventional food containers made from thermoplastic resins such as polyvinylidene chloride and polypropylene develop leak holes, and that food containers made from polyethylene are severely damaged, unless the resin structures are very thick, when they are employed at cooking temperatures of about 300° F. Thus, it would be desirable to provide a food container that could be used as a food storage bag, and that could also withstand thermal abuse, by providing thermoplastic resin containers capable of withstanding temperatures of about 280° F. on the inside of the container, and temperatures of more than about 350° F. on the outside of the container.

Another requirement for in-home use of such food containers is the capability of expelling air therefrom prior to closing them for the storage and preservation of foods. Typically, the expulsion of air from a food container would involve opening a small, i.e., about one-fourth to one inch, segment of the closure fastening device without the fastening device spontaneously completely deoccluding. However, some conventional closure devices do not possess such a controlled deocclusion or separation characteristic of the closure elements so as to enable the user to only partially open the container. A further requirement of thermoplastic containers used for cooking food is that the inside or pouch facing portion of the closure device be able to withstand much higher inflation forces than normally expected due to the development of internal pressure (such as by air expansion or steam generation), during the cooking of foods. An additional requirement of such food containers is that the thermoplastic material employed to make the closure device be compatible with the walls of the pouch to permit joining the closure device to the polymeric materials of the pouch walls or container sidewalls.

SUMMARY OF THE INVENTION

The foregoing criteria for a food container are met by the present invention which provides an interlocking closure fastening device connected to the two sidewalls of a container. The two sidewalls are sealed at the two side edges.

In one embodiment of this invention, the closure fastening device comprises a first flexible closure element having a general omega shape comprising an apex portion, and a profile portion extending from the apex portion, said apex portion being generally flat or slightly arcuate, and said profile portion comprising two inwardly curved arm portions terminating in two outwardly facing, curvilinear hook portions. The closure fastening device includes a second flexible closure element having a generally flat or slightly arcuate apex portion, and a profile extending from the apex portion. The profile portion of the second closure element comprises first and second generally parallel arm portions wherein one of the arm portions terminates in an inwardly curved hook portion, and the other arm portion curves slightly inward prior to terminating in an outwardly extending clamp portion. The first flexible closure element and the second flexible closure element are adapted to disengage and engage each other by means of a torquing action so as to form a straddling type of occlusion.

In another embodiment of this invention, the fastening device includes a first flexible closure element having a general omega shape comprising an apex portion, and a profile portion extending from the apex portion, said apex portion being generally flat or slightly arcuate, and said profile portion comprising two inwardly curved arm portions terminating in two outwardly curving hook portions. The closure device includes a second flexible closure element having a generally flat or slightly arcuate apex portion, and a profile portion extending from the apex portion. The profile portion of the second closure element comprises two outwardly curved arm portions wherein one of the arm portions terminates in an inwardly curved hook portion, and the other arm portion curves inwardly prior to terminating in a slightly outwardly curved hook portion. The first flexible closure element and the second flexible closure element are adapted to disengage and engage each other by means of a torquing action so as to form an overlapping type of occlusion.

In a further modification of the preceding embodiment, the profile portion of the second closure element comprises two outwardly curved arm portions wherein one of the arm portions terminates in an inwardly curved hook portion, and the other arm portion curves progressively inwardly as to make contact wih one of the arm portions of the first closure element, when the fastening device is occluded, prior to terminating in a slightly outwardly curved hook portion.

In a further embodiment of this invention, the fastening device includes a first flexible closure element, having a general omega shape comprising an apex portion, and a profile portion extending from the apex portion, said apex portion being generally flat or slightly arcuate, and said profile portion comprising two inwardly curved arm portions, an outwardly extending arm portion from each of said inwardly curved arm portions, each of said outwardly extending arm portions terminating in an outwardly curved hook portion. The closure device includes a second flexible closure element having a generally flat or slightly arcuate apex portion, and a profile portion extending from the apex portion. The profile portion of the second closure element comprises one inwardly curved arm portion terminating in an inwardly curved hook portion, and one generally straight arm portion extending from said apex portion in a generally perpendicular direction therefrom. The first flexible closure element and the second flexible closure element are adapted to disengage and engage each other by means of a torquing action so as to form a straddling type of occlusion.

In each of the foregoing embodiments, the first flexible closure element and the second flexible closure element are arranged in confronting relationship to each other with respect to their profile portions; and each of their apex portions may be permanently connected to a resin film forming the sidewalls of a container, said connection being made at or near the opening of the container. In addition, when the apex portion of one or both flexible closure element(s) is connected to a flange portion, the closure element(s) may be connected to the sidewall(s) via connection with the flange portion.

BRIEF DESCRIPTION OF THE DRAWINGS

FIG. 3-A is a cross-sectional view of a closure fastening device shown in FIG. 3 to illustrate typical physical dimensions;

DETAILED DESCRIPTION OF THE PREFERRED EMBODIMENTS

Figure 1:
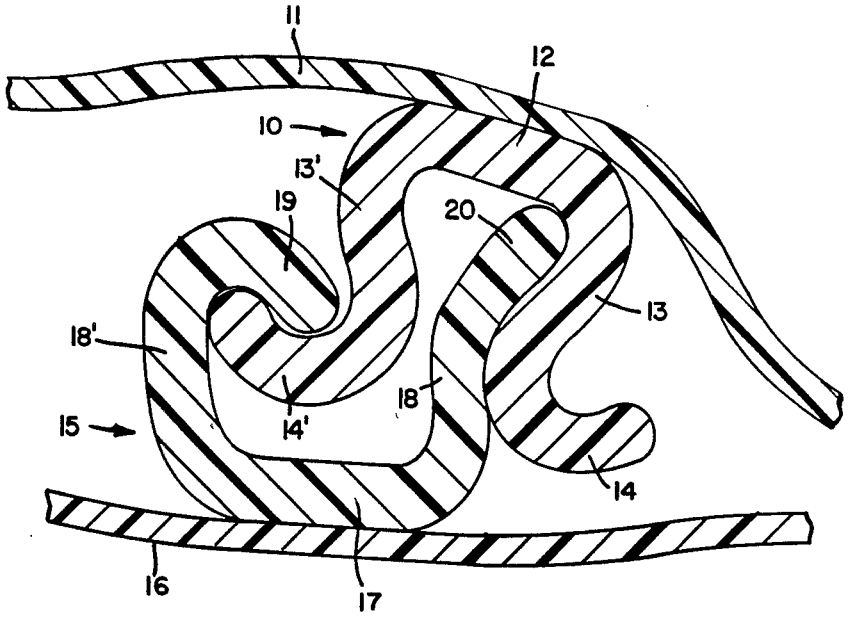
FIG. 1 is a cross-sectional view of one embodiment of the closure fastening device in accordance with this invention in an occluded position.

The closure fastening device employed with the container of the instant invention may be made from a thermoplastic material selected from the group consisting of polyolefins such as polyethylene, polypropylene, and polybutylene; polyamides such as nylon; or other thermoplastic materials, including combinations thereof. However, where thermal tolerance is required or when increased release forces are desired, the closure fastening device is preferably made from a thermoplastic resin composition comprising polypropylene, or a mixture of polypropylene resin and ethylene-propylene-diene monomer elastomer, or a mixture of polypropylene resin and ethylenepropylene copolymer elastomer. The dimensions of the container and the closure fastening device may vary in accordance with intended use, and depending upon the materials used in their manufacture because of the variations in physical properties, such as flexural moduli.

The closure fastening device can be manufactured by known methods, such as by extrusion, by the use of molds or other known methods of producing such devices. The closure fastening device can be manufactured as a strip for later attachment to a film or it can be manufactured integral with the film. In addition, the closure device can be manufactured with or without flanges on one or both of the closure elements, depending upon intended use or expected additional manufacturing operations.

The closure elements can be connected to a container or to a film to be formed into a container by the use of many known methods. For example, such methods include heat sealing, lamination, and adhesive attachment.

The connection between the film and the closure element can be established by the use of hot melt adhesives, or hot jets of air to the interface, or ultrasonic heating, or other known methods.

Generally, the present closure fastening device can be made from a heat sealable material and then attached to a heat sealable film so that a container can be formed economically by heat sealing surfaces to form the container.

The instant closure fastening device provides many advantages for consumers when used on containers. For instance, it is easy to close a container because the closure elements torque or twist with respect to each other from the deoccluded to the occluded position with little effort in spite of the high flexural moduli of the temperature resistant resins used. The action contrasts with prior art structures such as arrow type of closures where, in the female elements, the hooked sides have to be bent or otherwise distorted for occlusion or deocclusion. In a prior art channel closure, a base portion has to be bent to accomplish occlusion or deocclusion. And still another structure, made very stiff, requires longitudinal displacement to a non-hooked end before the male and female elements can be pried apart by elastic bending of portions of each element.

For a fuller understanding of the nature of the invention, reference should be had to the following detailed description, taken in conjunction with the accompanying drawings.

FIG. 1 is a cross-sectional view of one embodiment of the closure fastening device in accordance with this invention, in an occluded position. As shown therein, a first flexible closure element 10 having a general omega shape is connected to a flange portion 11 for use in connection to a thermoplastic film. Closure element 10 has an apex portion 12 which is generally flat or slightly arcuate, and extending from apex portion 12 is a profile portion which comprises two inwardly curved arm portions 13 and 13' which terminate in two outwardly curving hook portions 14 and 14', respectively. A second flexible closure element 15 is shown connected to a flange portion 16, and it comprises an apex portion 17 which may have a generally flat or slightly arcuate configuration. Extending from apex portion 17 is a profile portion comprising two generally parallel arm portions 18 and 18'. Arm portion 18' terminates in an inwardly curved hook portion 19, whereas arm portion 18 curves slightly inwardly prior to terminating in an outwardly extending clamp portion 20. As shown in FIG. 1, when the closure fastening device is in an occluded position, hook portion 14' of closure element 10 and hook portion 19 of closure element 15 are interlocked, and arm portion 18 and clamp portion 20 of closure element 15 are in locked contact with arm portion 13 of closure element 10. It can also be seen from FIG. 1 that arm portion 18' terminating in inwardly curved hook portion 19 is adapted to engage in a hinging contact with arm portion 13' terminating in outwardly curving hook portion 14', and arm portion 18 terminating in outwardly extending portion 20 is adapted to engage in a clamping contact with arm portion 13 terminating in outwardly curving hook portion 14. As can be seen from FIG. 1, closure element 10 and closure element 15 form a straddling occlusion wherein arm portion 18 and clamp portion 20 of closure element 15 are positioned between arm portion 13 and 13' of closure element 10.

When the closure fastening device is connected to a plastic container, arm portion 13 and hook portion 14 are positioned closest to the mouth or outside portion of the container, and arm portion 18' is positioned closest to the interior or inside portion of the container.

Figure 2:
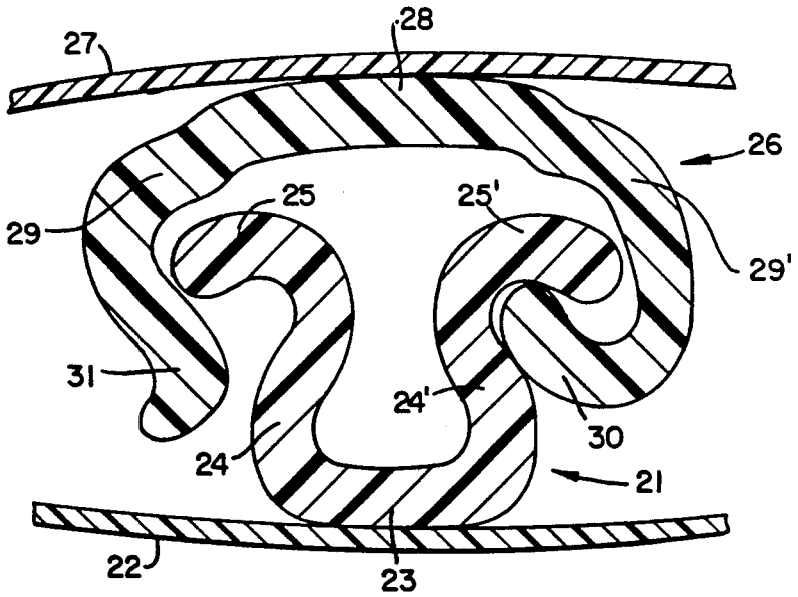
FIG. 2 is a cross-sectional view of another embodiment of the closure fastening device in accordance with this invention in an occluded position.

FIG. 2 is a cross-sectional view of another embodiment of the closure fastening device in accordance with this invention, in an occluded position. It may be seen therefrom that the first flexible closure element 21 has a general omega shape and that it may be connected to a flange portion 22 for connection to a thermoplastic film. Closure element 21 has an apex portion 23 which is slightly arcuate or generally flat, and extending from apex portion 23 is a profile portion which comprises two inwardly curved arm portions 24 and 24' which terminate in two outwardly curving hook portions 25 and 25', respectively. A second flexible closure element 26 is shown connected to a flange portion 27, and it comprises an apex portion 28 which has a generally flat or slightly arcuate configuration. Extending from apex portion 28 is a profile portion comprising two outwardly curving arm portions 29 and 29'. Arm portion 29' terminates in an inwardly curved hook portion 30, and arm portion 29 curves inwardly prior to terminating in a slightly outwardly curved hook portion 31. From FIG. 2, it may be seen that when the closure fastening device is in an occluded position, hook portion 25' of closure element 21 and hook portion 30 of closure element 26 are interlocked, while arm portion 29 and hook portion 31 of closure element 26 are in contact with hook portion 25 of closure element 21. It can also be seen from FIG. 2 that arm portion 29' terminating in inwardly curved hook portion 30 is adapted to engage in a hinging contact with arm portion 24' terminating in outwardly curving hook portion 25', and arm portion 24 terminating in outwardly curving hook portion 25 is adapted to engage in a clamping contact with arm portion 29 terminating in outwardly curved hook portion 31. It can further be seen from FIG. 2 that closure element 21 and closure element 26 form an overlapping type of occlusion wherein hook portion 30 of closure element 26 overlaps hook portion 25' of closure element 21, and arm portion 29 and hook portion 31 of closure element 26 overlap hook portion 25 of closure element 21. When thus occluded, arm portion 29 and hook portion 31 of closure element 26, and hook portion 25 of closure element 21 together form an easily disengageable structure, while hook portion 30 of closure element 26 and hook portion 25' of closure element 21 form a hinge structure which is strongly resistant to deocclusion without considerable rotation.

Figure 3:
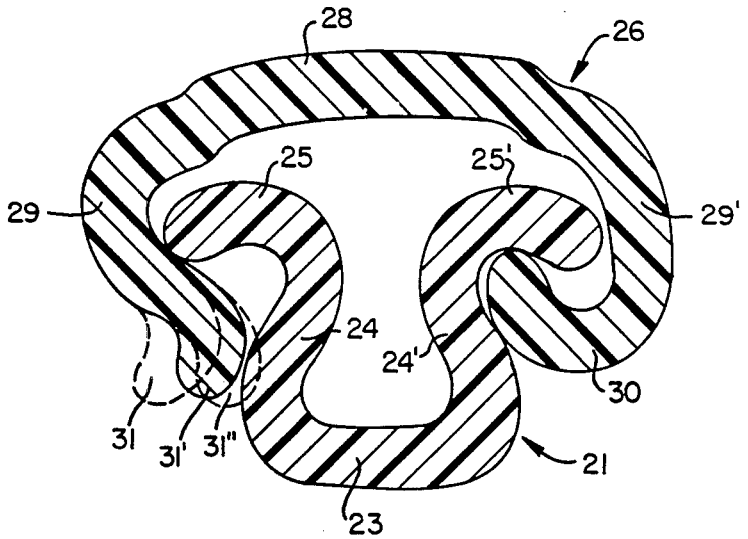
FIG. 3 is another cross-sectional view of the embodiment of the closure fastening device shown in FIG. 2.
Figure 4:
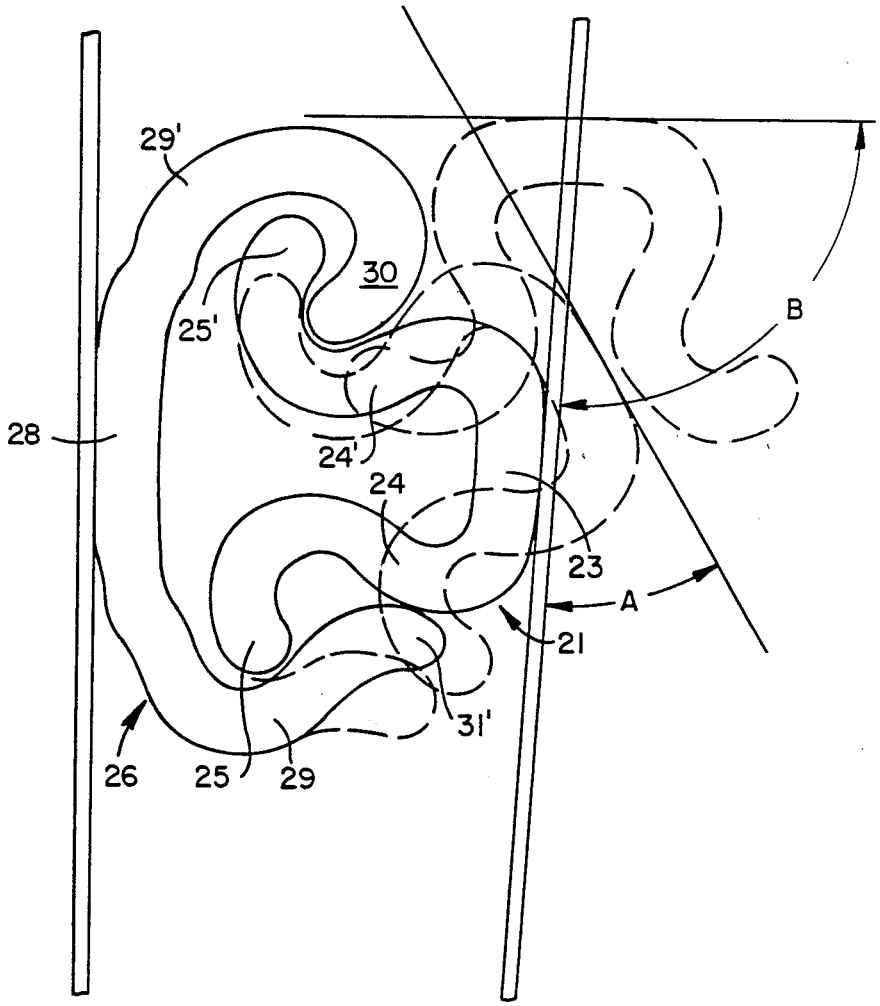
FIG. 4 is a cross-sectional view of the closure fastening device shown in FIG. 3 in an occluded position, in a partially deoccluded position, and in a deoccluded position.

FIG. 3 is a free body diagram showing a cross-sectional view of of the closure fastening device shown in FIG. 2. The first flexible closure element 21 shown therein is the same as that shown in FIG. 2. However, the second flexible closure element 26 has been modified, whereby hool portion 31 may be positioned progressively laterally inward, as depicted by alternate hook portion 31' and alternate hook portion 31'' shown in free body, toward arm portion 24 of closure element 21 until hook portion 31 makes contact with said arm portion 24 or is even deflected outwardly by arm portion 24. When the closure fastening device is thus constructed, the successively inward curvature of arm portion 29 and hook portion 31 to the positions shown by hook portion 31' and hook portion 31'' results in gradually increasing the opening force required to separate and deocclude closure element 26 and closure element 21. It has been found that successively inwardly curving hook portion 31 to the position depicted by hook portion 31'' results in increasing the external opening force required in deoccluding closure element 26 and closure element 21 from a force of about 0.5 pound to a force of about 2.0 pounds. It was also found that hook portion 31' and hook portion 31'' result in increased interference between these hook portions and hook portion 25, thereby requiring bending of these parts during deocclusion of closure element 26 and closure element 21. In operation, hook portions 31, 31', and 31'' act as a clamp in maintaining occlusion of the closure device. By the same token, hook portion 25' and hook portion 30 provide a hinge action during deocclusion of closure element 26 and closure element 21 whereby hook portion 25' rotates with respect to hook portion 30 as shown in FIG. 4.

Figure 3A:
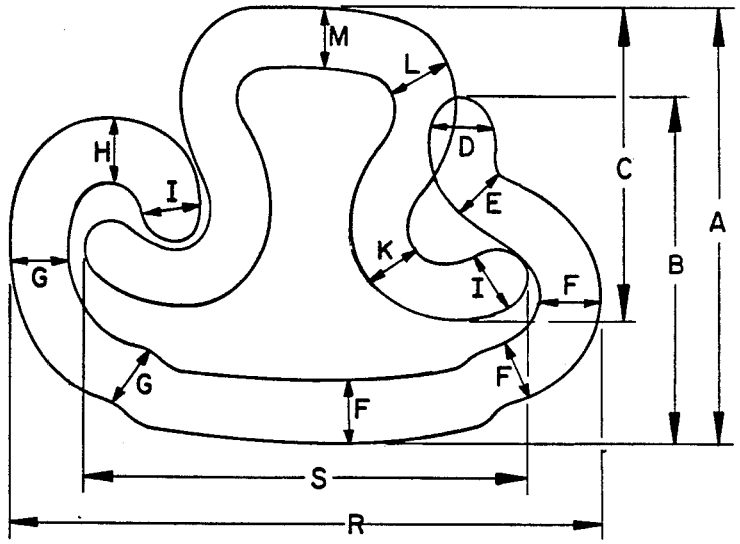

FIG. 3-A is a cross-sectional view of the closure fastening device shown in FIG. 3 wherein the second flexible closure element is modified pursuant to alternate hook portion 31''. The typical physical dimensions of a closure fastening device in accordance with FIG. 3A are as follows:

1. A may be from about 0.050 to about 0.100 inch, preferably about 0.078 inch;
2. B may be from about 0.040 to about 0.080 inch, preferably about 0.067 inch;
3. C may be from about 0.040 to about 0.080 inch, preferably about 0.060 inch;
4. D may be from about 0.007 to about 0.012 inch, preferably about 0.009 inch;
5. E may be from about 0.008 to about 0.015 inch, preferably about 0.011 inch;
6. F may be from about 0.008 to about 0.015 inch, preferably about 0.013 inch;
7. G may be from about 0.008 to about 0.015 inch, preferably about 0.012 inch;
8. H may be from about 0.008 to about 0.015 inch, preferably about 0.011 inch;
9. I may be from about 0.007 to about 0.012 inch, preferably about 0.008 inch;
10. K may be from about 0.008 to about 0.015 inch, preferably about 0.011 inch;
11. L may be from about 0.008 to about 0.015 inch, preferably about 0.012 inch;
12. M may be from about 0.009 to about 0.020 inch, preferably about 0.017 inch;
13. R may be from about 0.061 to about 0.130 inch, preferably about 0.108 inch; and
14. S may be from about 0.040 to about 0.105 inch, preferably about 0.078 inch.

As indicated in FIG. 3-A, A represents the height dimension of the closure fastening device in an occluded position as measured from the apex portion of the first closure element to the apex portion of the second closure element.

B represents the height dimension of the second closure element as measured from the apex portion of the second closure element to the tip of the second arm portion of the second closure element.

C represents the height dimension of the first closure element as measured from the apex portion of the first closure element to the highest part of the profile portion of the first closure element.

R represents the width dimension of the second closure element as measured from the widest part of the first arm portion of the second closure element to the widest part of the second arm portion of the second closure element.

S represents the width dimension of the first closure element as measured between the tips of the outwardly facing hook portions of the first closure element.

FIG. 4 is a cross-sectional view of the closure fastening device shown in FIG. 2 in an occluded position, in a partially deoccluded position, and in a deoccluded position. It has been found that during occlusion and deocclusion of the closure fastening device of this invention, one or both of the closure elements of the fastening device experience a gradual twisting or torquing operation spread over a significant length of the closure on either side of the point of initial force application. The spreading action of this torque reduces stress levels, thereby reducing force. During deocclusion of the fastening device, this twisting or torquing operation continues until the hook portions of the closure elements have disengaged from each other.

FIG. 4 shows in detail some of the operational steps during deocclusion of a closure fasening device as described with respect to FIG. 3 wherein the second closure element is modified pursuant to alternate hook portion 31'. More specifically, when said closure fastening device is in the occluded position, hook portion 31' of closure element 26 is in contact with arm portion 24 of closure element 21, or hook portion 25 of closure element 21 is in contact with arm portion 29 of closure element 26. Typically, for deocclusion of the closure fastening device, an external release force is exerted on hook portion 31' and arm portion 29 of closure element 26, and on hook portion 25 and arm portion 24 of closure element 21, to cause release of hook portion 31' and arm portion 29 of closure element 26, from hook portion 25 and arm portion 24 of closure element 21. The aforementioned parts of the fastening device are rotated over an arc of about 350° to a position generally designated as A, as shown by the arrows in FIG. 4. In order to obtain full release of the closure elements and deocclusion of the fastening device, rotation of the closure elements is continued over an arc of between about 100° and 120° to a position generally designated as B, as shown by the arrows in FIG. 4. During the continued rotation, arm portion 24' and hook portion 25' of closure element 21, disengage from hook portion 30 of closure element 26, while rotating around hook portion 30 of closure element 26 until the parts are separated from each other.

Figure 5:
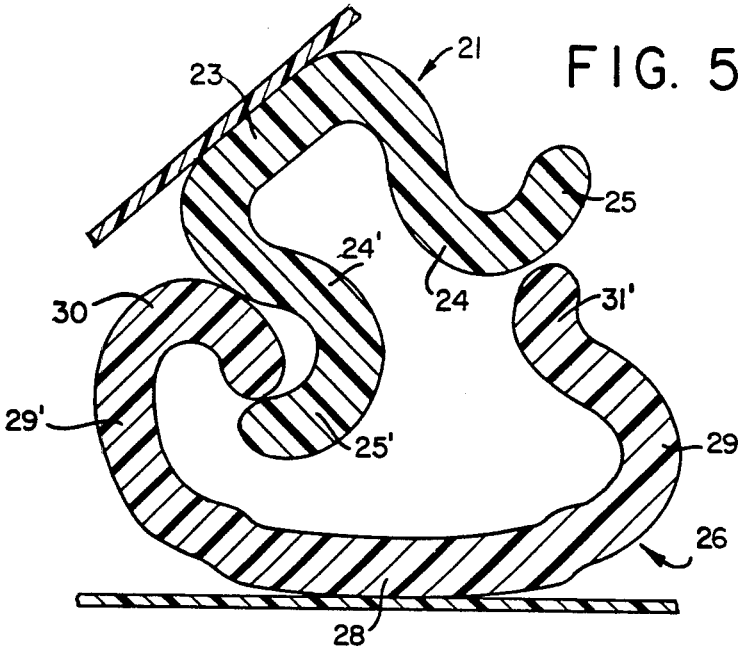
FIG. 5 is a cross-sectional view of a preferred embodiment of the closure fastening device in accordance with this invention in a partially deoccluded position.

If a closure fastening device is preferred requiring a small arc of rotation, resulting in earlier deocclusion of the closure elements, then closure element 21 and closure element 26 may be modified as described with respect to FIG. 5. In FIG. 5 is shown the closure elements described with respect to FIG. 4 with the following modifications having been made thereto. More particularly, the inside radius of curvature of hook portion 30 is decreased. During deocclusion of the closure fastening device, after hook portion 31' and arm portion 29 of closure element 26 are released from hook portion 25 and arm portion 24 of closure element 21, continued rotation of the closure elements results in hook portion 30 of closure element 26 having a camming or leverage effect upon arm portion 24' and hook portion 25' of closure element 21 to provide release of these parts at an arc of about 75°. The contact point between hook portion 30 of closure element 26 and arm portion 24' of closure element 21 is generally designated in FIG. 5 as point L, and the contact point between hook portion 30 of closure element 26 and hook portion 25' of closure element 21 is generally shown therein as point M. It has been found that the aforedescribed closure elements provide deocclusion of the occluded fastening device more quickly by requiring a lesser amount of rotation of the closure elements without affecting good occlusion.

It should be noted at this point that the actions discussed and illustrated for deocclusion apply in the reverse order to occlusion, which re-engages the hook elements forming the hinge structure, releases torsionally twisted elements and, by further movement, re-establishes the clamping action. This is predicted upon portions of the closure being maintained in an occluded position at the terminal ends of the closure device. Such a condition exists when a length of such a closure device is incorporated in a plastic bag having sealed side edges.

Figure 6:
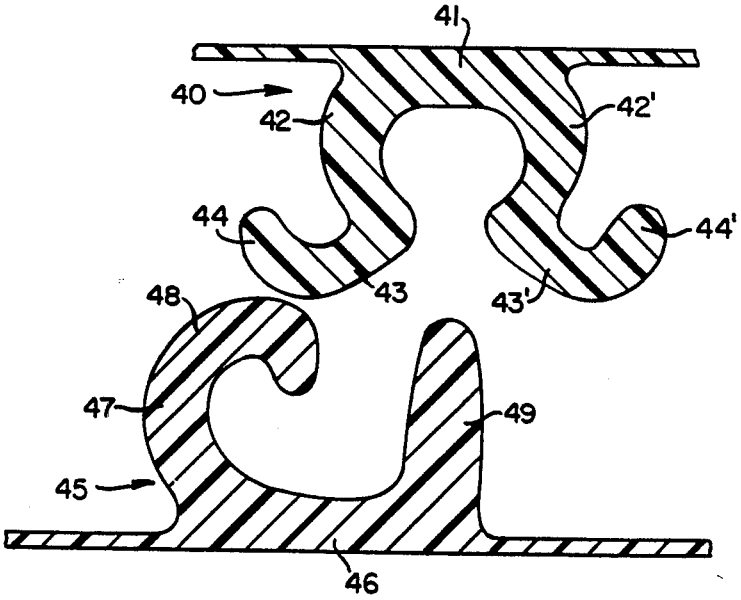
FIG. 6 is a cross-sectional view of another embodiment of the closure fastening device in accordance with this invention in a deoccluded position.

FIG. 6 is a cross-sectional view of another embodiment of the closure fastening device in accordance with this invention in a deoccluded position. As shown therein, the closure fastening device includes a first flexible closure element 40 having a general omega shape, and comprises a generally flat or slightly arcuate apex portion 41 and a profile portion extending from the apex portion. The profile portion comprises two inwardly curved arm portions 42 and 42', respectively, with arm portions 43 and 43' outwardly extending from said inwardly curved arm portions, respectively, and with said outwardly extending arm portions terminating in outwardly curving hook portions 44 and 44', respectively. The closure fastening device includes a second flexible closure element 45 having a generally flat or slightly arcuate apex portion 46 and a profile portion extending from said apex portion. The profile portion of said second closure element comprises one inwardly curved arm portion 47 terminating in an inwardly curved hook portion 48, and one generally straight arm portion 49 extending in a generally perpendicular direction from said apex portion.

Figure 7:
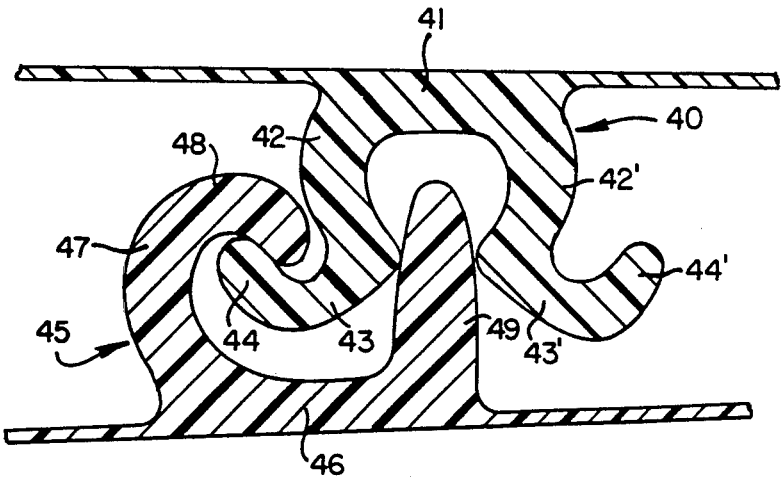
FIG. 7 is a cross-sectional view of the closure fastening device shown in FIG. 6 in an occluded position.

FIG. 7 is a cross-sectional view of the closure fastening device described with respect to FIG. 6, but shown herein in an occluded position. It can be seen from FIG. 7 that when the instant closure fastening device is in an occluded position, arm portion 49 of closure element 45 is located between and in contact with outwardly extending arm portions 43 and 43' of closure element 40, and hook portion 44 of closure element 40 is interlocked with hook portion 48 of closure element 45. It can also be seen from FIG. 7 that arm portion 43 terminating in outwardly curving hook portion 44 is adapted to engage in a hinging contact with arm portion 47 terminating in inwardly curved hook portion 48, and arm portion 49 is adapted to engage in a clamping contact with either arm portion 43 or arm portion 43' or both arm portion 43 and arm portion 43', but in any event, with at least one of said arm portions. When this closure fastening device is employed with a container, hook portion 44' and arm portion 49 are preferably located toward the outside portion of the container, and hook portion 44 and hook portion 48 are located toward the inside portion of the container. When thus located on a container, the closure fastening device of this invention provides a fastening device which is relatively easy to deocclude or open from the outside of the container, but which is relatively difficult to deocclude or open from the inside of the container. Accordingly, when thus employed on a container, the closure fastening device provides improved security to contents stored in said container.

Figure 8:
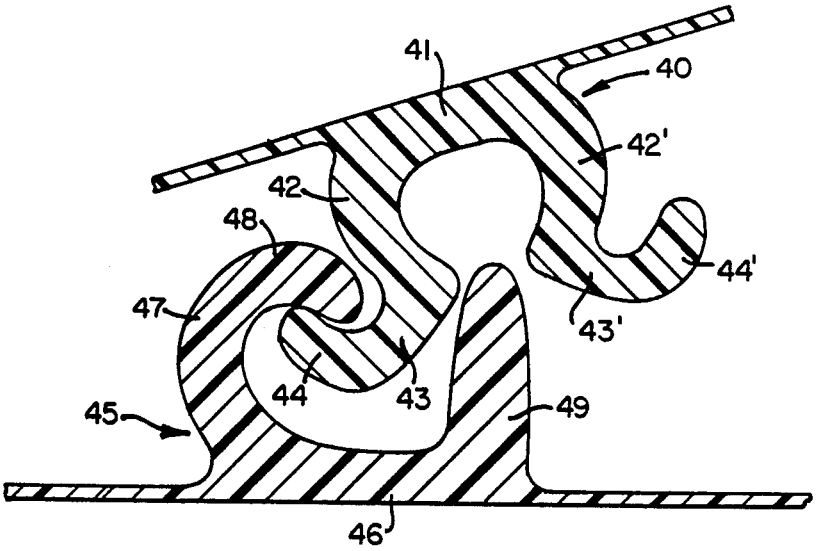
FIG. 8 is a cross-sectional view of the closure fastening device shown in FIG. 7 in a partially deoccluded position during deocclusion.

FIG. 8 is a cross-sectional view of the closure fastening device shown in FIG. 7 in a partially deoccluded position such as during deocclusion of the fastening device. It may be seen from FIG. 8 that during deocclusion of closure element 45 and closure element 40, arm portions 43 and 43' of closure element 40 first separate from arm portion 49 of closure element 45. As closure element 40 and closure element 45 are further rotated with respect to each other for separation, hook portion 44 of closure element 40 will rotate around and then slip away from hook portion 48 of closure element 45, thereby resulting in their separation and in the complete deocclusion of the closure fastening device.

Some of the preferred closure fastening devices of this invention were evaluated for opening loads for comparison with several commercial plastic container products having a closure fastening device. In all the evaluations each occluded closure fastening device was cut into a six inch long sample. The closure fastening device samples were tested by attaching a piece of one inch wide scotch tape doubled over to grip the inside and/or outside flange portions of the fastening device. Each sample was tested independently as described herein. The male portion of the closure fastening deivce was mounted in the upper jaw, and the female portion of the closure fastening device was mounted in the lower jaw, of an Instron® tensile tester. The force required to deocclude the closure fastening device was recorded on a strip chart recorder as the maximum force registered. The average value was listed as the average of five test specimens and it was recorded as release force. The jaw separation (deocclusion) rate was 20 inches per minute and the full scale load is 20 pounds. Each of 5 identical samples was reoccluded and retested for a total of 5 tests. The value reported was thus the average of 25 tests for each sample.

The Instron instrument was a tensile tester Model No. 1130, using a "B" load cell with a zero to 20 pound range. The Instron tester is initially calibrated in the following manner. The pen and chart recorder are turned on. The zero button is pressed and held, and the zero adjust knob is positioned for a 0.00 reading on the recorder. The zero button is then released. The range switch is then turned to the setting of 1 on its 1, 2, 5, 10, 20 scale. The coarse balance control is turned so that if the pen is all the way over to the left, it starts coming toward zero on the right. The coarse balance control is left at this position. Then the fine balance control is turned so that the pen is at a setting of 0.00. A 20 pound weight is placed in the upper jaw of the Instron instrument and the calibration control is adjusted for a full-scale recorder reading. After removing the weight, the recorder should again read 0.00. The zero button is pressed and held, and the recorder should again read 0.00.

Sample 1 represents a closure fastening device employed with a container available from Dow Chemical Company, Midland, Mich. under the tradename ZIPLOC®. The closure fastening device is believed to have been made with low density polyethylene having a density of about 0.921 grams per cubic centimeter.

Sample 2 represents a closure fastening device employed with a container available from Dow Chemical Company, Midland, Mich. under the tradename ZIPLOC® Microfreez.

Sample 3 represents a closure fastening device produced by Union Carbide Corporation and commercially available with a container identified as SNAP LOCK®. The closure fastening device was made with low density polyethylene, that is, having a density of about 0.923 grams per cubic centimeter.

Sample 4 represents a closure fastening device prepared in accordance with this invention and as described herein with repspect to FIG. 3, wherein the second flexible closure element was modified pursuant to alternate hook portion 31'.

Sample 5 represents a closure fastening device prepared in accordance with this invention and as described herein with respect to FIG. 3, wherein the second flexible closure element was modified pursuant to alternate hook portion 31''.

The closure fastening devices of Sample 4 and Sample 5 were made with a thermoplastic resin composition comprising about 84 percent by weight of polypropylene homopolymer, about 15 percent by weight of an ethylene-propylene-diene monomer elastomer, and about 1 percent by weight of a slip agent, all weight percentages being based on the weight of the fastening device.

Both external release forces and internal release forces were recorded. By external release forces is meant the forces required to deocclude the closure fastening device from the outside portion of a container. By internal release forces is meant the forces required to deocclude the closure fastening device from the inside portion of a container.

The test results are given below in Table 1.

TABLE I

| Sample | Release Force (lbs) Internal | Release Force (lbs) External | Release Force Ratio (Internal:External) |
|---|---|---|---|
| 1 | 3.8 | 1.5 | 2.5:1.0 |
| 2 | 3.3 | 1.6 | 2.1:1.0 |
| 3 | 4.5 | 2.5 | 1.8:1.0 |
| 4 | 10.0 | 0.5 | 20.0:1.0 |

TABLE I-continued

| Sample | Release Force (lbs) Internal | Release Force (lbs) External | Release Force Ratio (Internal:External) |
|---|---|---|---|
| 5 | 12.0 | 2.0 | 6.0:1.0 |

From the above results in Table 1, it can be seen that the closure fastening devices employed in this invention provide internal release resistance forces which are between two and three times as high as those of some commerical closure fastening devices, while manipulative external deocclusion forces may be held to a minimum, thereby providing easy and gentle deocclusion of the closure fastening devices employed for the containers of this invention.

Figure 9:
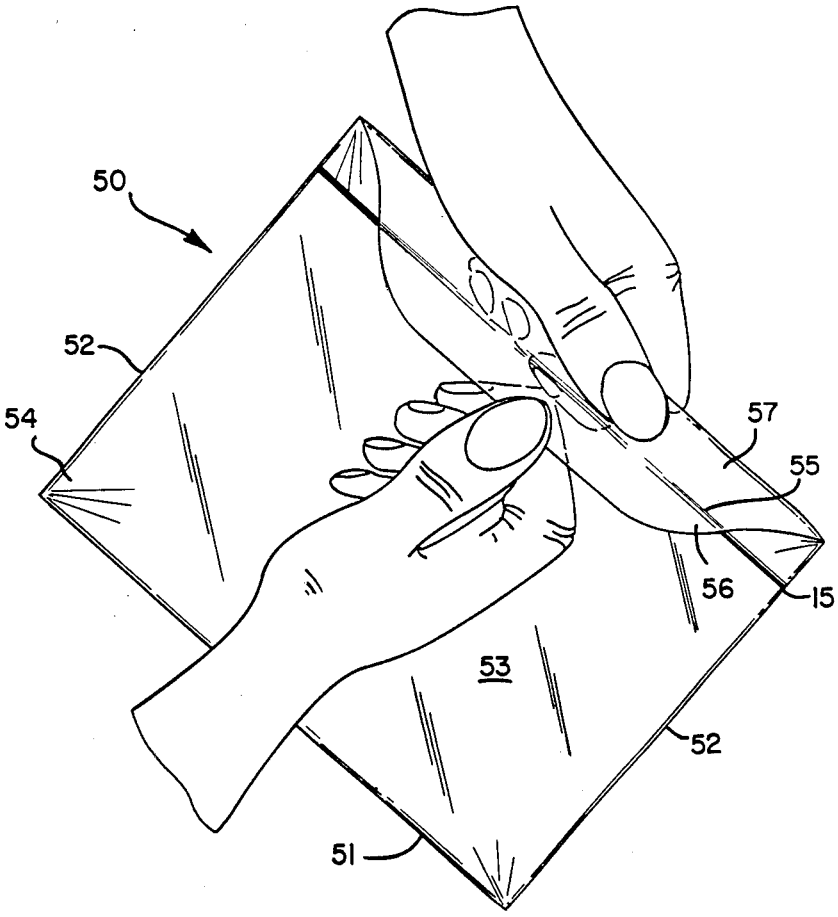
FIG. 9 is a perspective view of a container in accordance with this invention.

FIG. 9 is a perspective view of a container 50 in accordance with this invention formed from a thin thermoplastic multilayer film which has been folded at the bottom portion 51, and which has been heat-sealed along the side edges 52. Sidewalls 54 extend beyond a closure device 55 to provide mouth portions 56 and 57 to simplify the opening of the closure device 55, such as by pulling mouth portion 56 away from mouth portion 57 in the direction of the arrow shown in FIG. 9.

As employed herein, the inside hook portions of the closure element comprise those hook portions of the closure elements which are located closer to the interior portion of the container when the closure elements are attached to or made integral with the sidewalls of the container. Likewise, the outside hook portions of the closure elements comprise those hook portions of the closure elements which are located closer to the exterior, opening portion of the container when the closure elements are attached to or made integral with the sidewalls of the container. Further, the inside hook and arm portions of the closure elements may be considered to comprise a hinge unit, and the outside hook and arm portions of the closure elements may be considered to comprise a clamp or latch unit.

When the aforedescribed closure fastening devices are connected by flanges to the sidewalls of the instant containers, an unexpected additional benefit accrues to the containers during their use in cooking foods. That is, it has always been considered desirable that closure fastening devices be designed so as to be sensitive to increases in vapor pressure within the bag during cooking in order that the closure elements may automatically deocclude and permit venting of the container to avoid its rupture. In accordance with this invention, a closure device as depicted in FIG. 2 and described in relation thereto, was heat-sealed to a multilayer film forming the sidewalls of the containers. The closure device included flange portion 27 and flange portion 22 heat-sealed to apex portion 28 and apex portion 23, respectively. Flange portion 27 and flange portion 22 were each heat-sealed to one of the sidewalls in forming the container. The multilayer film forming the sidewalls comprised an outer layer of nylon-6 and an inner layer of polypropylene copolymer. The thermoplastic materials employed in making the closure device including the flange portions comprised about 84 percent by weight of polypropylene homopolymer, about 15 percent by weight of an ethylene-propylene-diene monomer elastomer, and about 1 percent by weight of a slip agent, all weight percentages being based on the weight of the closure elements. The container was employed to cook food in boiling water. It was found that during boiling of the food, evaporation of the container contents caused inflation of the container, which however caused the container to float and limit further inflation by condensation of steam on the inside of the top surface of the container.

Figure 10:
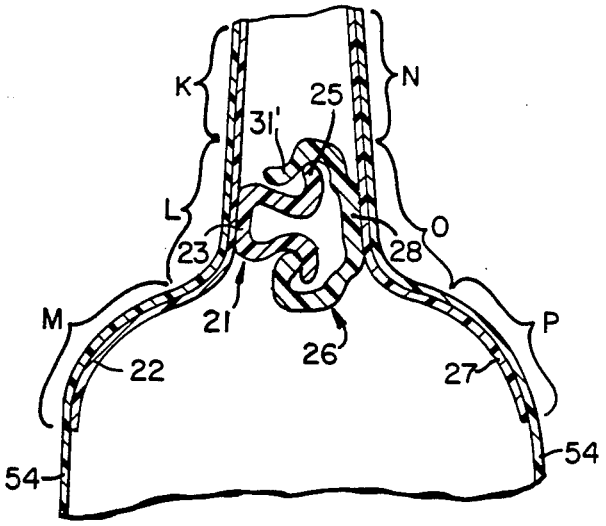
FIG. 10 is a cross-sectional view of the top portion of a container in accordance with this invention in an occluded position.

FIG. 10 is a cross-sectional view of the top portion of a container in accordance with this invention in an occluded position, illustrating that closure element 21 and closure element 26 remain in their occluded position when sidewalls 54 are exposed to the normal pressures involved with cooking foods in boiling water. In the construction of this container, attachment of closure flange portion 22 and flange portion 27 was limited to the dimensions given in Table 2 as K, M, N, P.

TABLE 2

| | |
|---|---|
| K = 0.625 inch | N = 0.625 inch |
| L = 0.250 inch | O = 0.250 inch |
| M = 0.625 inch | P = 0.625 inch |
| K + L + M = 1.5 inch | N + O + P = 1.5 inch |

It will be noted that in this example, L and O are unattached central portions of the flanges and that K+L+M or N+O+P constitute the total flange width indicated by 22 and 27. These dimensions could change by selecting different flange widths. Also, flange portion 22 and flange portion 27 were fabricated from a polymer significantly weaker in tensile strength than the film of sidewalls 54, and thin enough to permit the flange portions to stretch along dimensions L and O without causing a corresponding stretch in sidewalls 54.

Figure 11:
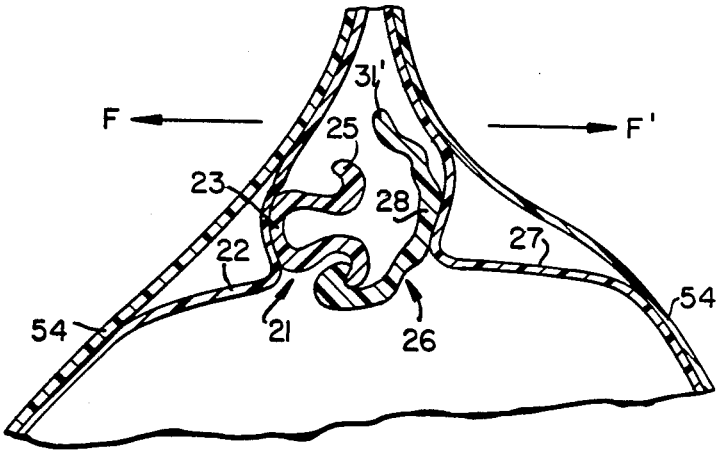
FIG. 11 is a cross-sectional view of the top portion of a container in accordance with this invention in a partially deoccluded position.

FIG. 11 is a cross-sectional view of the top portion of a container described pursuant to FIG. 10 in a partially deoccluded position such as occurs when cooking foods in a microwave oven at a temperature of about 290° F. without providing a vapor vent. It can be seen therefrom that the overpressure which can develop in the container can cause the central portions of flanges 22 and 27, which are not heat-sealed to sidewalls 54, to stretch, but the sidewalls 54 of this container do not stretch. This distortion of the closure flanges which starts in the inside of the pouch causes the development of pull-apart forces F and F′ acting in opposite directions thereby releasing the clamping action of closure hook portions 25 and 31 as earlier described with respect to FIG. 3. With deocclusion now started, further spreading action now causes the rotative release shown in FIG. 5 and the excess pressures developed in the container are released before they cause explosive-like destruction of the bag walls or side seals. Accordingly, when the container of this invention is thus constructed, the configuration of the closure elements and the materials employed, result in a safety release fastening device for use in a microwave oven at elevated cooking temperatures.

The thermoplastic film material employed to form the sidewalls of the instant container may be any suitable film material. Typical thermoplastic film materials include polyolefins such as low density polyethylene, medium density polyethylene, high density polyethylene, polypropylene and polybutylene; polyamides such as nylon-6, nylon-6.6 and nylon-12; polybutylene terephthalate; polyethylene terephthalate; ethylene-vinyl alcohol; and mixtures thereof. The thermoplastic film material may be a single layer film or multilayer film. However, a multilayer film is preferred. When the film material is a multilayer film, it is preferred that the film comprise at least two layers of different film materials hwerein the outer layer film material has a higher melt temperature than the inner layer film material. The inner layer film material may be selected from polyolefins such as polyethylene having a melt temperature of between about 107° C. and about 137° C. However, it is preferred to have an inner layer having a melt temperature of at least about 140° C. to about 150° C. Various polypropylenes meet such a melt temperature specification. Correspondingly, the outer layer film material may be selected from a polyester such as polyethylene terephthalate having a melt temperature of about 250° C., or a polyamide such as nylon-6 having a melt temperature of about 215° C. However, when polar resins are employed to form the multilayer film, it is advisable to employ a bonding layer between the inner layer and the outer layer to avoid delamination of the multilayer film. For this purpose, the bonding layer may be selected from adhesive resins such as ionomer copolymers, modified polyolefins, ethylene-vinyl acetate copolymers, ethylene-acrylic acid copolymers, polyolefins grafted with acrylic acid, and other multi-polymer compositions.

In one embodiment, the multilayer film comprises a two-layer film having an outer layer of a heat-resistant thermoplastic resin selected from the group consisting of polyesters, polyamides, polysulfones, polyaryl sulfones, and polycarbonates, and an inner layer of a thermoplastic resin selected from the group consisting of polyolefins having the aforedescribed characteristics and properties. In a preferred mode of this embodiment, the multilayer film comprises an outer layer of a polyamide and an inner layer of a polyolefin.

In another embodiment, the multilayer film comprises a three-layer film having an outer layer of a heat-resistant thermoplastic resin selected from the group consisting of polyesters, polyamides, polysulfones, polyaryl sulfones, and polycarbonates, a core layer of an adhesive resin having a high melting point and resistance to heat, and an inner layer of a thermoplastic resin selected from the group consisting of,polyolefins. In a preferred mode of this embodiment, the multilayer film comprises an outer layer of a polyamide, a core layer of an adhesive resin, and an inner layer of a polyolefin resin.

More particularly, suitable outer layer film materials include polyesters such as polyethylene terephthalate, polyamides such as nylon-6, nylon-6.6, and nylon-12, polysulfones, polyaryl sulfones, and polycarbonates. However, it is preferred that the outer layer film material comprise a polyamide, and more preferably, that the polyamide comprise a nylon-6, such as that commercially available under the tradename Capron-8207 from the Allied Chemical Company. The inner layer thermoplastic resin film material may suitably include polyolefins such as low and high density polyethylenes, polypropylene, and polybutylene. However, of the polyolefin resins, polypropylene is preferred for the inner film layer because of its higher melting point and better resistance to heat.

When the multilayer film comprises a three-layer film having an adhesive resin bonding layer between the outer layer and the inner layer, the bonding layer should be sufficient to provide a bonding strength between said outer layer and said inner layer of at least about 200 grams/inch of film.

Any suitable bonding material, or mixtures thereof, that exhibit strong adhesion to polar resins may be employed as the bonding layer between the outer layer and the inner layer in the multilayer films used for the container of this invention. Typical bonding materials include adhesive resins such as ionomer copolymers, chemically modified polyolefins, ethylene-vinyl acetate copolymers, ethylene-acrylic acid copolymers, polyolefins grafted with acrylic acid, and other multipolymer compositions. The chemically modified polyolefin may be obtained from a number of polyolefin resins, such as high, medium and low density polyethylenes, polypropylenes, ethylene-vinyl acetate copolymers, and ethylene-acrylic acid copolyers, which are modified by the provision of functional groups to the polymer which have a strong affinity for the nylon molecule, and which will form strong bonds to nylon under the heat and pressure involved in the coextrusion process. These bonding materials are generally commercially available, for example, ionomer copolymers may be obtained from E. I. Du Pont de Nemours under the tradename Surlyn® resin. Likewise, the modified polyolefins are available from Chemplex Company of Rolling Meadows, Ill., under the tradename Plexar® resins, such as Plexar-3 which is a modified ethylene-vinyl acetate copolymer adapted for cast film coextrusion. The preferred bonding materials are selected from modified polyolefins such as Plexar-3, and other multipolymer compositions such as CXA-3101, available from E. I. Du Pont de Nemours and Co.

The bonding layer between the outer layer and the inner layer of the multilayer films employed for the container of this invention may have any suitable thickness. Typically, the thickness of the bonding layer may be from about 0.1 mil to about 0.2 mil, preferably about 0.15 mil. When present, the thickness of the bonding layer may range from about 10 percent to about 20 percent of the total thickness of the multilayer films used in the container of this invention.

The total thickness of the multilayer films used in the container of this invention may range from about 1 mil to about 3 mils, preferably from about 1.3 mils to about 2.5 mils, and more preferably, about 1.6 mils. The thickness of the outer layer may range from about 0.1 mil to about 0.5 mil, preferably from about 0.3 mil to about 0.4 mil. The thickness of the inner layer may range from about 0.5 mil to about 2.0 mils, and preferably from about 1.0 mil to about 1.5 mils.

The multilayer films used in the container of this invention may have an outer layer to inner layer thickness ratio of between about 1:2 and about 1:20, but the preferred outer layer to inner layer thickness ratio is between about 1:3 and about 1:5.

The multilayer films employed in this invention, may be produced by any of several well-known methods. Preferably, the film may be produced by what is commonly known as the slot cast extrusion method. The film may also be produced by what is commonly known as the air blown film tubular extrusion method, but this latter method is less preferred. The slot cast method produces a film of better clarity than the other methods known to the art. The multilayer film may be slot cast on extrusion equipment using a slot cast multiple-orifice diel or a multilayer adapter for a single layer slot cast die.

In addition to the embodiments shown herein, the closure elements can be positioned on opposite sides of a film. Such an embodiment would be suited for enwrapping an object or a collection of objects such as wires. Generally, the elements on a film should be parallel to each other but this would depend on the intended use.

Although the present invention has been described and set forth in some detail, it should be further understood that the same is susceptible to changes, modifications and variations without departing from the scope and spirit of the invention as set forth in the appended claims. Such changes, modifications and variations are within the scope of this invention.

I claim:

1. A containers comprising two sidewalls and a closure fastening device, said fastening device comprising a first closure element and a second closure element; said first closure element having a general omega shape, comprising an apex portion and a profile portion extending from said apex portion, said profile portion comprising two inwardly curved arm portions terminating in two outwardly facing hook portions; said second closure element comprising an apex portion and a profile portion extending from said apex portion, said profile portion comprising first and second arm portions, wherein said first arm portion terminates in an inwardly curved hook portion adapted to engage in a hinging contact with one arm portion of said first closure element, and said second arm portion is adapted to engage in a clamping contact with one arm portion of said first closure element and wherein said first closure element and said second closure element are adapted to engage and disengage each other by means of a torquing action.

2. A container in accordance with claim 1 wherein said arm portions of said second closure element are generally parallel to each other.

3. A container in accordance with claim 1 wherein said arm portions of said second closure element are outwardly curved.

4. A container in accordance with claim 1 wherein said first arm portion of said second closure element is inwardly curved before terminating in said inwardly curved hook portion.

5. A container in accordance with claim 1 wherein said second arm portion of said second closure element terminates in an outwardly extending portion.

6. A container in accordance with claim 5 wherein said second closure element curves inwardly before terminating in said outwardly extending portion.

7. A container in accordance with claim 1 wherein said second arm portion of said second closure element is generally straight and extends generally perpendicular from said apex portion of said second closure element.

8. A container in accordance with claim 1 wherein said first closure element and said second closure element are adapted to engage and disengage each other by means of a torquing action so as to form a straddling occlusion.

9. A container in accordance with claim 1 wherein said first closure element and said second closure element are adapted to engage and disengage each other by means of a torquing action so as to form an overlapping occlusion.

10. A container in accordance with claim 1 wherein said apex portion of said first closure element is arcuate.

11. A container in accordance with claim 1 wherein said apex portion of said first closure element is generally flat.

12. A container in accordance with claim 1 wherein said outwardly facing hook portions of said first closure element are curvilinear.

13. A container in accordance with claim 1 wherein said apex portion of said second closure element is arcuate.

14. A container in accordance with claim 1 wherein said apex portion of said second closure element is generally flat.

15. A container in accordance with claim 1 wherein said first closure element and said second closure element are made from thermoplastic materials.

16. A container in accordance with claim 15 wherein said thermoplastic materials are selected from the group consisting of polyolefins and polyamides.

17. A container in accordance with claim 16 wherein said polyolefins include polyethylene, polypropylene, and polybutene.

18. A container in accordance with claim 1 wherein said first closure element and said second closure element are made from a mixture of polypropylene and ethylene-propylene-diene monomer elastomer, or a mixture of polypropylene and ethylene-propylene copolymer elastomer.

19. A container in accordance with claim 1 wherein said closure fastening device in an occluded position has a height of between about 0.050 to about 0.100 inch as measured from the apex portion of said first closure element to the apex portion of said second closure element.

20. A container in accordance with claim 1 wherein said second closure element has a height of between about 0.040 to about 0.080 inch as measured from the apex portion of said second closure element to the tip of said second arm portion of said second closure element.

21. A container in accordance with claim 1 wherein said first closure element has a height of between about 0.040 to about 0.080 inch as measured from the apex portion of said first closure element to the highest part of the profile portion of said first closure element.

22. A container in accordance with claim 1 wherein said second closure element has a width of between about 0.061 to about 0.130 inch as measured from the widest part of said first arm portion of said second closure element to the widest part of said second arm portion of said second closure element.

23. A container in accordance with claim 1 wherein said first closure element has a width of between about 0.040 to about 0.105 inch as measured between the tips of said outwardly facing hook portions of said first closure element.

24. A container in accordance with claim 1 wherein said sidewalls comprise a multilayer film having at least one outer layer of thermoplastic resin material and at least one inner layer of thermoplastic resin material, and wherein said outer layer material has a higher melt temperature than said inner layer material.

25. A container in accordance with claim 24 wherein said inner layer of thermoplastic resin material has a melt temperature of at least about 140° C.

26. A container in accordance with claim 24 wherein said outer layer material is selected from the group consisting of polyester, polyamides, polysulfones, polyaryl sulfones, and polycarbonates.

27. A container in accordance with claim 24 wherein said inner layer material is selected from the group consisting of polyolefins.

28. A container in accordance with claim 24 wherein said multilayer film includes a bonding layer between said outer layer and said inner layer.

29. A container in accordance with claim 1 wherein said first closure element and said second closure element are arranged in confronting relationship to each other and are permanently connected to said sidewalls near the opening of said container.

30. A container in accordance with claim 1 including flange portions attached to each of said first closure element and said second closure element and to each of said sidewalls.

31. A container in accordance with claim 30 wherein said flange portions include a central portion which is unattached to each of said sidewalls.

32. A container in accordance with claim 31 wherein said flange portions are fabricated from a polymer significantly weaker in tensile strength than the film of said sidewalls, thereby to permit said central portions to stretch without causing a corresponding stretch in said sidewalls.

33. A container in accordance with claim 31 wherein said flange portions are fabricated thin enough to permit said central portions to stretch without causing a corresponding stretch in said sidewalls.

34. A container in accordance with claim 31 wherein said flange portions are fabricated from a polymer significantly weaker in tensile strength than the film of said sidewalls, and thin enough to permit said central portions to stretch without causing a corresponding stretch in said sidewalls.

35. A container in accordance with claim 31 wherein said closure device automatically opens to permit the venting of vapor pressure within the container during the heating of contents in said container.

36. A container in accordance with claim 1 wherein the thickness of said sidewalls is from about 1 mil to about 3 mils.

37. A container comprising two sidewalls and a closure fastening deivce, said fastening device comprising a first closure element and a second closure element;said first closure element having a general omega shape, comprising an apex portion and a profile portion extending from said apex portion, said profile portion comprising two inwardly curved arm portions terminating in two outwardly facing hook portions; said second closure element comprising an apex portion and a profile portion extending from said apex portion, said profile portion comprising generally parallel first and second arm portions, wherein said first arm portion terminates in an inwardly curved hook portion adapted to engage in a hinging contact with one arm portion of said first closure element, and said second arm portion terminates in an outwardly extending portion adapted to engage in a clamping contact with one arm portion of said first closure element and wherein said first closure element and said second closure element are adapted to engage and disengage each other by means of a torquing action.

38. A container in accordance with claim 37 wherein said second arm portion of said second closure element curves inward before terminating in said outwardly extending portion.

39. A container in accordance with claim 37 wherein said first closure element and said second closure element are adapted to engage and disengage each other by means of a torquing action so as to form a straddling occlusion.

40. A container in accordance with claim 37 wherein said first closure element and said second closure element are made from thermoplastic materials.

41. A container in accordance with claim 40 wherein said thermoplastic materials are selected from the group consisting of polyolefins and polyamides.

42. A container in accordance with claim 41 wherein said polyolefins include polyethylene, polypropylene, and polybutene.

43. A container in accordance with claim 37 wherein said first closure element and said second closure element are made from a mixture of polypropylene and ethylene-propylene-diene monomer elastomer, or a mixture of polypropylene and ethylene-propylene copolymer elastomer.

44. A container in accordance with claim 37 wherein said sidewalls comprise a multilayer film having at least one outer layer of thermoplastic resin material and at least one inner layer of thermoplastic resin material, and wherein said outer layer material has a higher melt temperature than said inner layer material.

45. A container in accordance with claim 44 wherein said inner layer of thermoplastic resin material has a melt temperature of a least about 140° C.

46. A container in accordance with claim 44 wherein said outer layer material is selected from the group consisting of polyesters, polyamides, polysulfones, polyaryl sulfones, and polycarbonates.

47. A container in accordance with claim 44 wherein said inner layer material is selected from the group consisting of polyolefins.

48. A container in accordance with claim 44 wherein said multilayer film includes a bonding layer between said outer layer and said inner layer.

49. A container in accordance with claim 37 wherein said first closure element and said second closure element are arranged in confronting relationship to each other and are permanently connected to said sidewalls near the opening of said container.

50. A container in accordance with claim 37 including flange portions attached to each of said first closure element and said second closure element and to each of said sidewalls.

51. A container in accordance with claim 50 wherein said flange portions include a central portion which is unattached to each of said sidewalls.

52. A container in accordance with claim 51 wherein said flange portions are fabricated from a polymer significantly weaker in tensile strength than the film of said sidewalls, thereby to permit said central portions to stretch without causing a corresponding stretch in said sidewalls.

53. A container in accordance with claim 51 wherein said flange portions are fabricated thin enough to permit said central portions to stretch without causing a corresponding stretch in said sidewalls.

54. A container in accordance with claim 51 wherein said flange portions are fabricated from a polymer significantly weaker in tensile strength than the film of said sidewalls, and thin enough to permit said central portions to stretch without causing a corresponding stretch in said sidewalls.

55. A container in accordance with claim 51 wherein said closure device automatically opens to permit the venting of vapor pressure within the container during the heating of contents in said container.

56. A container in accordance with claim 37 wherein the thickness of said sidewalls is from about 1 mil to about 3 mils.

57. A container comprising two sidewalls and a closure fastening device said fastening device comprising a first closure element and a second closure element; said first closure element having a general omega shape, comprising an apex portion and a profile portion extending from said apex portion, said profile portion comprising two inwardly curved arm portions, an outwardly extending arm portion from each of said inwardly curved arm portions, each of said outwardly extending arm portions terminating in an outwardly curved hook portion; said second closure element comprising an apex portion and a profile portion extending from said apex portion, said profile portion comprising first and second arm portions, wherein said first arm portion terminates in an inwardly curved hook portion adapted to engage in a hinging contact with one arm portion of said first closure element, and said second arm portion extends in a generally perpendicular direction from said apex portion and is adapted to engage in a clamping contact with at least one arm portion of said first closure element and wherein said first closure element and said second closure element are adapted to engage and disengage each other by means of a torquing action.

58. A container in accordance with claim 57 wherein said first closure element and said second closure element are adapted to engage and disengage each other by means of a torquing action so as to form a straddling occlusion.

59. A container in accordance with claim 57 wherein said first closure element and said second closure element are made from thermoplastic materials.

60. A container in accordance with claim 59 wherein siad thermoplastic materials are selected from the group consisting of polyolefins and polyamides.

61. A container in accordance with claim 60 wherein said polyolefins include polyethylene, polypropylene, and polybutene.

62. A container in accordance with claim 57 wherein said first closure element and said second closure element are made from a mixture of polypropylene and ethylene-propylene-diene monomer elastomer, or a mixture of polypropylene and ethylene-propylene copolymer elastomer.

63. A container in accordance with claim 57 wherein said sidewalls comprise a multilayer film having at least one outer layer of thermoplastic resin material and at least one inner layer of thermoplastic resin material, and wherein said outer layer material has a higher melt temperature that said inner layer material.

64. A container in accordance with claim 63 wherein said inner layer of thermoplastic resin material has a melt temperature of at least about 140° C.

65. A container in accordance with claim 63 wherein said outer layer material is selected from the group consisting of polyesters, polyamides, polysulfones, polyaryl sulfones, and polycarbonates.

66. A container in accordance with claim 63 wherein said inner layer material is selected from the group consisting of polyolefins.

67. A container in accordance with claim 63 wherein said multilayer film includes a bonding layer between said outer layer and said inner layer.

68. A container in accordance with claim 57 wherein said first closure element and said second closure element are arranged in confronting relationship to each other and are permanently connected to said sidewalls near the opening of said container.

69. A container in accordance with claim 57 including flange portions attached to each of said first closure element and said second closure element and to each of said sidewalls.

70. A container in accordance with claim 69 wherein said flange portions include a central portion which is unattached to each of said sidewalls.

71. A container in accordance with claim 70 wherein said flange portions are fabricated from a polymer significantly weaker in tensile strength than the film of said sidewalls, thereby to permit said central portions to stretch without causing a corresponding stretch in said sidewalls.

72. A container in accordance with claim 70 wherein said flange portions are fabricated thin enough to permit said central portions to stretch without causing a corresponding stretch in said sidewalls.

73. A container in accordance with claim 70 wherein said flange portions are fabricated from a polymer significantly weaker in tensile strength than the film of said sidewalls, and thin enough to permit said central portions to stretch without causing a corresponding stretch in said sidewalls.

74. A container in accordance with claim 70 wherein said closure device automatically opens to permit the venting of vapor pressure within the container during the heating of contents in said container.

75. A container in accordance with claim 57 wherein the thickness of said sidewalls is from about 1 mil to about 3 mils.

* * * * *

UNITED STATES PATENT AND TRADEMARK OFFICE

CERTIFICATE OF CORRECTION

PATENT NO. : 4,767,220

DATED : August 30, 1988

INVENTOR(S) : Ewald Albert Kamp

It is certified that error appears in the above-identified patent and that said Letters Patent is hereby corrected as shown below:

Column 2, line 11: Replace "finging" with "finding".

Column 8, line 65: Delete "350°" and replace with "35°".

Column 13, line 68: Replace "hwerein" with "wherein".

Signed and Sealed this

Sixteenth Day of February, 1993

*Attest:*

STEPHEN G. KUNIN

*Attesting Officer*

*Acting Commissioner of Patents and Trademarks*